United States Patent [19]

Williams et al.

[11] 4,198,477

[45] Apr. 15, 1980

[54] METHOD OF USING ELECTROSTATOGRAPHIC TONER COMPOSITION WITH SURFACTANT

[75] Inventors: Meurig W. Williams; Christopher J. AuClair, both of Rochester, N.Y.

[73] Assignee: Xerox Corporation, Stamford, Conn.

[21] Appl. No.: 962,529

[22] Filed: Nov. 20, 1978

Related U.S. Application Data

[62] Division of Ser. No. 773,083, Feb. 28, 1977, Pat. No. 4,139,483.

[51] Int. Cl.[2] ..... G03G 13/08

[52] U.S. Cl. ..... 430/120; 430/110;

[58] Field of Search.....252/62.1P; 96/1 SD

[56] References Cited

U.S. PATENT DOCUMENTS

| | | | |
|---|---|---|---|
| 2,701,814 | 2/1955 | Smith | 252/351 X |
| 2,764,603 | 9/1956 | Ahlbrecht | 252/DIG. 1 |
| 3,052,717 | 9/1962 | Regan | 252/351 X |
| 3,678,068 | 7/1972 | Anello et al. | 252/351 X |
| 3,706,773 | 12/1972 | Anello et al. | 252/351 X |
| 3,919,110 | 11/1975 | Vassilindes et al. | 252/402 X |
| 3,948,654 | 4/1976 | Fisher | 252/62.1 P X |
| 3,970,571 | 7/1976 | Olson et al. | 252/62.1 P |
| 3,977,871 | 8/1976 | Crooks | 252/62.1 P X |
| 3,983,045 | 9/1976 | Jugle et al. | 96/1 SD X |
| 4,002,570 | 1/1977 | Lindblad et al. | 252/62.1 P |

*Primary Examiner*—Roland E. Martin, Jr.

*Attorney, Agent, or Firm*—D. C. Petre; E. O. Palazzo; R. J. Grandmaison

[57] ABSTRACT

A finely-divided toner composition comprising a thermoplastic vinyl resin and a surface active additive selected from the group consisting of fluorinated surfactants. The toner composition possesses controlled triboelectric charging properties while its other bulk properties remain unaffected. Developer compositions and electrostatographic imaging processes are also disclosed.

10 Claims, No Drawings

METHOD OF USING ELECTROSTATOGRAPHIC TONER COMPOSITION WITH SURFACTANT

This application is a divisional application of copending application Ser. No. 773,083, filed on Feb. 28, 1977, now U.S. Pat. No. 4,139,483.

BACKGROUND OF THE INVENTION

This invention relates to imaging systems, and more particularly, to improved xerographic developing materials, their manufacture and use.

The formation and development of images on the surface of photoconductor materials by electrostatic means is well known. The basic xerographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting latent electrostatic image by depositing on the image a finely divided electroscopic material referred to in the art as "toner". The toner will normally be attracted to those areas of the layer which retain a charge, thereby forming a toner image corresponding to the latent electrostatic image. This powder image may then be transferred to a support surface such as paper. The transferred image may subsequently be permanently affixed to the support surface as by heat. Instead of latent image formation by uniformly charging the photoconductive layer and then exposing the layer to a light-and-shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing steps.

Several methods are known for applying the electroscopic particles to the latent electrostatic image to be developed. One development method, as disclosed by E. N. Wise in U.S. Pat. No. 2,618,552, is known as "cascade" development. In this method, a developer material comprising relatively large carrier particles having finely divided toner particles electrostatically coated thereon is conveyed to and rolled or cascaded across the electrostatic latent image bearing surface. The composition of the carrier particles is so selected as to triboelectrically charge the toner particles to the desired polarity. As the mixture cascades or rolls across the image bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier and excess toner are then recycled. This technique is extremely good for the development of line copy images.

Another method of developing electrostatic images is the "magnetic brush" process as disclosed, for example, in U.S. Pat. No. 2,874,063. In this method, a developer material containing toner and magnetic carrier particles are carried by a magnet. The magnetic field of the magnet causes alignment of the magnetic carrier into a brush-like configuration. This "magnetic brush" is engaged with the electrostatic image-bearing surface and the toner particles are drawn from the brush to the latent image by electrostatic attraction.

Still another technique for developing electrostatic latent images is the "powder cloud" process as disclosed, for example, by C. F. Carlson in U.S. Pat. No. 2,221,776. In this method, a developer material comprising electrically charged toner particles in a gaseous fluid is passed adjacent the surface bearing the latent electrostatic image. The toner particles are drawn by electrostatic attraction from the gas to the latent image. This process is particularly useful in continuous tone development.

Other development methods such as "touchdown" development as disclosed by R. W. Gundlach in U.S. Pat. No. 3,166,432 may be used where suitable.

Thus, it is apparent that the toner material must be capable of accepting a charge of the correct polarity when brought into rubbing contact with the surface of carrier materials in cascade, magnetic brush or tough-down development systems. Some resinous materials which possess many properties which would be desirable in xerographic toners dispense poorly and cannot be used in automatic copying and duplicating machines. Other resins dispense well but form images which are characterized by low density, poor resolution, or high background. Further, some resins are unsuitable for processes where electrostatic transfer is employed. Since most toner materials are deficient in one or more of the above areas, there is a continuing need for improved toners and developers.

SUMMARY OF THE INVENTION

It is, therefore, an object of this invention to provide a toner overcoming the above noted deficiencies.

It is another object of this invention to provide a toner which is resistant to film formation when employed in conventional xerographic copying and duplicating devices.

It is another object of this invention to provide a xerographic toner which forms images having reduced background.

It is another object of this invention to provide a free flowing toner which is resistant to agglomeration.

It is another object of this invention to provide a xerographic toner which has improved triboelectric properties.

It is another object of this invention to provide a xerographic toner which forms high resolution images.

It is another object of this invention to provide a xerographic toner which is resistant to mechanical attrition during the development process.

It is another object of this invention to provide a xerographic toner having improved electrostatic transfer characteristics.

It is another object of this invention to provide a toner and developer having physical and chemical properties superior to those of known toners and developers.

The above objects and others are accomplished by providing a finely divided toner composition comprising a colorant, a thermoplastic resin, and a surface active additive which is capable of providing a desired polarity and magnitude of triboelectric charging potential to the toner composition. In addition to providing the aforementioned triboelectric properties to the toner compositions of this invention, the surface active additive also provides toner compositions which have antistick or low surface energy properties thereby minimizing their filming on carrier particles such as by impaction thereon, and which also have improved triboelectrostatic transfer properties.

In accordance with this invention, the surface active additive is dispersed in rather than coated on a toner the toner material. In preparation of the toner compositions of this invention, it is preferred that the resin components be melted or dissolved followed by the addition of the colorant and the surface active additive thereto, the components thoroughly mixed to yield a uniform mixture of the additive in the thermoplastic resin body. The resulting mixed composition is then spray-dried to yield toner particles having an average particle size of less than about 30 microns, preferably in the range of about 7 to 12 microns. In this fashion, the surface active additive is part of the toner material per se, however, due to its low surface energy properties, the surface active additive generally resides at or near the surface of the toner particles.

The suface active additives of this invention are selected from highly fluorinated materials. These highly fluorinated materials are fluorochemical surface active agents, also known as fluorochemical surfactants and comprise ionic solubilizing groups linked to highly branchedperfluoro groups. Typical compositions include ammonium perfluoroalkyl sulfonates, potassium perfluoroalkyl sulfonates, potassium fluorinated alkyl carboxylates, and ammonium perfluoroalkyl carboxylates. These compositions are commercially available under the tradename Monflor available from ICI America, Zonyl from E. I. duPont, and Fluorad from 3M. These materials contain anionic, cationic, or nonionic groups providing a wide rage of surface active behavior. They are extremely active and in concentrations of as low as 0.1% are available to reduce the surface tension of polymers to values as low as 20 dynes/cm. These surface active additives, by virtue of their low surface energy or the extent of their compatibility or association with the polymer matrix, will preferentially reside close to the polymer-air interface, so long as thermodynamic equilibrium is allowed to occur within the processing time period. The concentration required for modification of polymer surface properties such as triboelectric charging is extremely low so that other bulk properties, such as impaction and fusing, of the toner composition are not adversely affected.

Satisfactory results may be obtained with surface active additives such as monomers and polymers containing ionic groups, for example, tetraheptyl ammonium bromide, neutralized acrylic acid or vinyl pyridine containing copolymers, and silicones. However, the preferred surface active additives of this invention are the aforementioned fluorinated surfactants containing a cationic or anionic group because when present in small quantities such as 0.01 to 0.05% by weight of the toner composition, the additive will cause a toner material to tribolelectrically charge positively relative to a metallic carrier material such as uncoated steel particles. Without the surface active additive in the toner composition, the toner material charges negatively with the described carrier material. In the open literature, it is well known that fluorinated materials always provide negative triboelectric charging properties. Invariably, these materials are at the most negative end of any triboelectric series. Thus, it is unexpected to employ fluorinated materials as surface active additives in toner materials and obtain toner compositions which charge positively relative to steel carrier particles. Although it is not fully understood as to the reasons for this unexpected finding, it is believed that it is the low surface energy of the fluorine component of the fluorinated surface active additive which enables its concentration in the subsurface layers of the toner material, and that the triboelectric charging properties of the toner material are dominated by the ionic group of the fluorinated suface active additive. It has been found that ionic groups which are cationic or anionic provide modified toner compositions which generate positive triboelectric charges, whereas where the ionic group is nonionic the toner compositions generate negative triboelectric charges. In addition, whether or not ionic fluorinated surface active additives provide positive or negative triboelectric charging properties to a toner composition has been found to depend on the given process employed in preparing the toner compositions. That is, where toner preparation by spray-drying is employed, the surface active additive will provide a positive triboelectric charging potential to the toner particles. This may be due to the conflict in the direction of charging polarity, that is, negative or positive, where the fluorine component has a tendency to charge to a negative polarity whereas the ionic component has a tendency to charge to a positive polarity. In the toner compositions of this invention, the triboelectric charging results obtained are a critical function of the toner preparation process. Thus, by spray-drying the toner compositions of this invention, the troboelectric charging forces of the ionic component of the fluorinated surface active additive predominate resulting in a net positive triboelectric charge in toner compositions containing a fluorinated material.

The toner compositions of this invention may contain from about 0.001 percent to about 0.5 percent by weight, based on the weight of the toner composition, of the surface active additive. Preferably, the toner compositions of this invention contain from about 0.01 percent to about 0.2 percent by weight of the surface active additive because the desired polarity and magnitude of triboelectric charging potential are achieved. Optimum results are obtained when the toner compositions of this invention contain from about 0.03 percent to about 0.06 percent by weight, based on the weight of the toner composition, of the surface active additives of this invention. Further, the toner compositions of this invention provide reduced impaction onto carrier particles thereby extending carrier particle life.

Any suitable resin having a melting point of at least about 110° F. may be employed in the toners of this invention. Preferably, the resin is a vinyl resin which may be a homopolymer or a copolymer of two or more vinyl monomers. Typical monomeric units which may be employed to form vinyl polymers include: styrene, p-chlorostyrene, vinyl naphthalene; ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 20 chlorethyl acrylate, phenyl acrylate, methylalpha-chloroacylate, methyl methacrylate, ethyl methacrylate, butyl methacrylate and the like, acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl ispropenyl ketone and the like; vinylidene halides such as vinylidene chloride, vinylidene chloro-fluoride and the like; and N-vinyl compounds such as N-vinyl pyrrole, N-vinyl carbazole, N-vinyl indole, N-vinyl pyrrolidene and the like; and mixtures thereof. Generally, suitable resins employed in the toner have a weight average molecular weight between about 3,000 to about 500,000.

Toner resins containing a relatively high percentage of a styrene resin are preferred. The presence of a styrene resin is preferred because a greater degree of image definition is achieved with a given quantity of additive material. Further, denser images are obtained when at least about 25 percent by weight, based on the total weight of resin in the toner, of a styrene resin is present in the toner. The styrene resin may be a homopolymer of styrene or styrene homolques or copolymers of styrene with other monomeric groups containing a single methylene group attached to a carbon atom by a double bond. Thus, typical monomeric materials which may be copolymerized with styrene by addition polymerization include: p-chlorostyrene; vinyl naphthalene; ethylenically unsaturated mono-olefins such as theylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chlorethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidene and the like; and mixtures thereof. The styrene resins may also be formed by the polymerization of mixtures of two or more of these unsaturated monomeric materials with a styrene monomer. The expression "addition polymerization" is intended to include known polymerization techniques such as free radical, anionic and cationic polymerization processes.

The resins, including styrene type resins, may also be blended with one or more other resins if desired. When the resin is blended with another resin, the added resin is preferably a vinyl resin because the resulting blend is characterized by especially good triboelectric stability and uniform resistance against physical degradation. The toner resins employed for blending with the styrene type or other vinyl resin may be prepared by the addition polymerization of any suitable monomer such as the vinyl monomers described above. Thus, other thermoplastic resins which may be blended with the toner resins of this invention include nonvinyl types such as rosin modified phenol formaldehyde resins, oil modified epoxy resins, polyurethane resins, cellulosic resins, polyether resins and mixtures thereof. The toner resin may have a single or bimodal molecular weight distribution, and it may be at least partially crosslinked. When the resin component of the toner contains styrene copolymerized with another unsaturated monomer or a blend of polysturene and another resin, a styrene component of at least about 25 percent by weight, based on the total weight of the resin present in the toner is preferred because denser images are obtained and a greater degree of image definition is achieved with a given quantity of additive materials.

The combination of the resin component, colorant and additive, whether the resin component is a homopolymer, copolymer or blend, should have a blocking temperature of at least about 110° F. and a melt viscosity of less than about 2.5 ;33 $10^{-4}$ poise at temperatures up to about 450° F. When the toner is characterized by a blocking temperature less than about 110° F. the toner particles tend to agglomerate during storage and machine operation and also form undesirable firms of the surface of reusable photoreceptors which adversely affect image qualtity. If the melt viscosity of the toner is greater than about $2.5\times10^{-4}$ poise at temperatures above about 450° F., the toner material of this invention does not adhere properly to a receiving sheet even under conventional xerographic machines fusing conditions and may easily be removed by rubbing.

Any suitable pigment or dye may be employed as the colorant for the toner particles. Toner colorants are well known and include, for example, carbon black, nigrosine dye, aniline blue, Calco Oil Blue, chrome yellow, ultra marine blue, duPont Oil Red, Quinoline Yellow, methylene blue chloride, phthalocyanine blue, Malachite Green Oxalate, lamp black, Rose Bengal and mixtures thereof. The pigment of dyes should be present in the toner in a quantity sufficient to render it highly colored so that it will form a clearly visible image on a recording member. Thus, for example, where conventional xerographic copies of typed documents are desired, the toner may comprise a black pigment such as carbon black or a black dye such as Amaplast Black dye, available from National Aniline Products, Inc. Preferably, the pigment is employed in an amount from about 3 percent to about 20 percent, by weight, based on the total weight of the colored toner. If the toner colorant employed is a dye, substantially smaller quantities of colorant may be used.

The toner compositions of the present invention are prepared by spray-drying the ingredients to the desired particle size. In addition, where desired, the toner compositions of this invention may be spray-dried followed by attrition to reduce the particle size.

When the toner mixtures of this invention are to be employed in a magnetic brush development process, the toner should have an average particle size of less than about 30 microns and preferably between about 4 and about 20 microns for optimum results. For use in powder cloud development methods, particle diameters of slightly less than 1 micron are preferred.

Suitable coated and uncoated carrier materials for electrostatographic development are well known in the art. The carrier particles may comprise any suitable solid material, provided that the carrier particles acquire a charge having an opposite polarity to that of the toner particles when brought in close contact with the toner particles so that the toner particles adhere to and surround the carrier particles. In accordance with this invention, the carrier particle is selected so that the toner particles acquire a positive charge and the carrier particles acquire a negative triboelectric charge. Thus, the materials for the carrier particles are selected in accordance with their triboelectric properties in respect to the electroscopic toner so that when mixed or brought into mutual contact, the toner component of the developer is charged positively, and the carrier component is charged negatively. By proper selection of developer materials in accordance with their triboelectric properties, the polarities of their charge when mixed are such that the electroscopic toner particles adhere to and are coated on the surfaces of carrier particles and also adhere to that portion of the electrostatic image-bearing surface having a greater attraction for the toner than the carrier particles. Typical carriers include sodium chloride, ammonium chloride, aluminum potassium chloride, Rochelle salt, sodium nitrate, aluminum nitrate, potassium chlorate, granular zircon, granular silicon, methyl methacrylate, glass, silicon, dioxide, nickel, steel, iron, ferrites and the like. The carriers may be employed with or without a coating, they may be partially coated with a polymer, or may be at least partially oxidized. Many of the foregoing and other typical carriers are described by L. E. Walkup et al. in U.S. Pat. No. 2,638,416 and E. N. Wise in U.S. Pat. No. 2,618,552. An ultimate carrier particle diameter between about 50 microns to about 1,000 microns is preferred because the carrier particles than possess sufficient density and inertia to avoid adherence to the electrostatic images during the development process. Adherence of carrier beads to electrostatographic drums is undesirable because of the formation of deep scratches on the surface during the imaging transfer and drum cleaning steps, particularly where cleaning is accomplished by a web cleaner such as the web disclosed by W. P. Graff, Jr. et al. in U.S. Pat. No. 3,186,838. Also print deletion occurs when carrier beads adhere to electrostatographic imaging surfaces. Generally speaking, satisfactory results are obtained when about 1 part toner is used with about 10 to 200 parts by weight of carrier The toner compositions of the instant invention may be employed to develop electrostatic latent images on any suitable electrostatic latent image-bearing surface including conventional photoconductive surfaces. Well known photoconductive materials include vitreous selenium, organic or inorganic photoconductors embedded in a non-photoconductive matrix, organic or inorganic photoconductors embedded in a photoconductive matrix, or the like. Representative patents in which photoconductive materials are disclosed include U.S. Pat. No. 2,803,542 to Ullrich, U.S. Pat. No. 2,970,906 to Bixby, U.S. Pat. No. 3,121,006 to Middleton, U.S. Pat. No. 3,121,007 to Middleton and U.S. Pat. No. 3,151,982 to Corrsin.

In the following examples, the relative triboelectric values generated by contact of carrier beads with toner particles is measured by means of a Faraday Cage. The device comprises a brass cylinder having a diameter of about one inch and a length of about one inch. A 100-mesh screen is positioned at each end of the cylinder. The cylinder is weighed, charged with about 0.5 gram mixture of carrier and toner particles and connected to ground through a capacitor and an electrometer connected in parallel. Dry compressed air is then blown through the brass cylinder to drive all the toner from the carrier. The charge on the capacitor is then read on the electrometer. Next, the chamber is reweighted to determine the weight loss. The resulting data is used to calculate the toner concentration and the charge in microcoulombs per gram of toner. Since the triboelectric measurements are relative, the measurements should, for comparative purposes, be conducted under substantially identical conditions.

DESCRIPTION OF PREFERRED EMBODIMENTS

The following examples further define, describe and compare methods of preparing the toner materials of the present invention and of utilizing them to develop electrostatic latent images. Parts and percentages are by weight unless otherwise indicated.

Example I

A control toner material is prepared comprising about 90 parts of resin components comprising about 65 parts by weight of styrene and 35 parts by weight of butyl methacrylate. After dissolving in acetone and preliminary mixing, about 10 parts of carbon black as a colorant is added to the solution and thoroughly mixed to yield a uniformly dispersed composition. The resulting mixture is spray-dried to yield toner particles having an average particle size of about 10 microns. The toner particles are then placed in a vacuum oven at about 30° C. to remove residual solvent. About 1 part by weight of the dried toner particles was mixed with about 99 parts by weight of steel carrier particles having an average diameter of about 100 microns. The resulting developer mixture was mixed for about 60 minutes after which it was evaluated for triboelectric charging response pursuant to the aforementioned method. It was found that this toner material obtained a triboelectric charge of about −15.0 microcoulombs per gram of toner.

EXAMPLE II

A toner composition was prepared as in Example I except that about 0.05 parts by weight based on the weight of the toner composition of a surface active additive consisting of Zonyl FSC (a cationic fluorinated surfactant) available from E. I. DuPont was added to the resin and colorant components while they were in dispersion and mixed therewith. The resulting mixture was spray-dried as in Example I to yield toner particles having an average particle size of about 10 microns. The toner particles were further dried as in Example I. About 1 part by weight of the dried toner particles was mixed with about 99 parts by weight of steel carrier particles as in Example I. The resulting developer mixture was mixed for about 60 minutes after which it was evaluated for triboelectric charging response as in Example I. It was found that this toner material generated a triboelectric charge of about +20.0 micro-coulombs per gram of toner.

Example III

A toner composition was prepared as in Example II except that the Zonyl FSC therein was replaced with about 0.05 parts by weight of a surface active additive consisting of Zonyl FSP (an anionic fluorinated surfactant) available from E. I. DuPont. After spray-drying and further drying as in Example I, about 1 part of the toner particles was mixed with about 99 parts by weight of steel carrier particles as in Example I. The resulting developer mixture was mixed for about 60 minutes after which it was evaluated for triboelectric charging response as in Example I. It was found that this toner material generated a triboelectric charge of about +15.0 micro-coulombs per gram of toner.

Example IV

A toner composition was prepared as in Example II except that the Zonyl FSC therein was replaced with about 0.2 parts by weight of a surface active additive consisting of Zonyl FSP (an anionic fluorinated surfactant) available from E. I. DuPont. After spray-drying and further drying as in Example I, about 1 part of the toner particles was mixed with about 99 parts by weight of steel carrier particles as in Example I. The resulting developer mixture was mixed for about 60 minutes after which it was evaluated for triboelectric charging response as in Example I. It was found that this toner material generated a triboelectric charge of about +20.0 micro-coulombs per gram of toner.

Although specific materials and conditions are set forth in the foregoing examples, these are merely intended as illustrations of the present invention. Various other suitable thermoplastic toner resin components, additives, colorants, and development processes such as those listed above may be substituted for those in the example with similar results. Other materials may also be added to the toner or carrier to sensitize, synergize or otherwise improve the fusing properties or other desirable properties of the system.

Other modifications of the present invention will occur to those skilled in the art upon a reading of the present disclosure. These are intended to be included within the scope of this invention.

What is claimed is:

1. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of carrier particles having an average particle diameter of between about 50 microns and about 1,000 microns, said toner particles comprising a colorant, a thermoplastic resin, and a surface active additive dispersed in said toner particles, said surface active additive being capable of providing a positive triboelectric charging potential to said toner particles, said surface active additive being selected from highly fluorinated materials having an ionic group, said ionic group being selected from a cationic group and an anionic group, whereby at least a portion of said finely-divided toner particles is attracted to and deposited on said recording surface in conformance with said electrostatic latent image.

2. An electrostatographic imaging process in accordance with claim 1 wherein said highly fluorinated materials comprise fluorinated surfactants.

3. An electrostatographic imaging process in accordance with claim 1 wherein said fluorinated surfactants comprise anionic surfactants.

4. An electrostatographic imaging process in accordance with claim 1 wherein said fluorinated surfactants comprise cationic surfactants.

5. An electrostatographic imaging process in accordance with claim 1 wherein said surface active additive resides in subsurface layers of said toner particles.

6. An electrostatographic imaging process in accordance with claim 1 wherein said toner particles have an average particle size of less than about 30 microns.

7. An electrostatographic imaging process in accordance with claim 1 wherein said surface active additive is present in an amount of from about 0.001 percent to about 0.5 percent by weight based on the weight of said toner particles.

8. An electrostatographic imaging process in accordance with claim 1 wherein said colorant, said thermoplastic resin, and said surface active additive have been thoroughly mixed to yield a uniform mixture and then spray-dried to form said finely-divided toner particles.

9. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of carrier particles having an average particle diameter of between about 50 microns and about 1,000 microns, said toner particles comprising a colorant, a thermoplastic resin, and a surface active additive dispersed in said toner particles, said surface active additive being capable of providing a positive triboelectric charging potential to said toner particles, said surface active additive being selected from highly fluorinated materials having an ionic group, said ionic group being selected from a cationic group and an anionic group, said toner particles having been prepared by dissolving said thermoplastic resin and thoroughly mixing said colorant, said thermoplastic resin and said surface active additive to yield a uniform mixture which is then spray-dried to form said finely-divided toner particles, whereby at least a portion of said finely-divided toner particles is attracted to and deposited on said recording surface in conformance with said electrostatic latent image.

10. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of carrier particles having an average particle diameter of between about 50 microns and about 1,000 microns, said toner particles comprising a colorant, a thermoplastic resin, and a surface active additive dispersed in said toner particles, said surface active additive being capable of providing a positive triboelectric charging potential to said toner particles, said surface active additive being selected from monomers and polymers containing ionic groups consisting of tetraheptyl ammonium bromide, neutralized acrylic acid, and vinyl pyridine, whereby at least a portion of said finely-divided toner particles is attracted to and deposited on said recording surface in conformance with said electrostatic latent image.

* * * * *